US006169365B1

(12) United States Patent
Kubon et al.

(10) Patent No.: US 6,169,365 B1
(45) **Date of Patent: *Jan. 2, 2001**

(54) HIGH-PRESSURE METAL HALIDE LAMP HAVING THREE PART ELECTRODE RODS

(75) Inventors: Marcus Kubon, Aachen; Robert P. Scholl, Roetgen, both of (DE)

(73) Assignee: U.S. Philips Corporation, New York, NY (US)

( * ) Notice: Under 35 U.S.C. 154(b), the term of this patent shall be extended for 0 days.

This patent is subject to a terminal disclaimer.

(21) Appl. No.: 09/171,058

(22) PCT Filed: Feb. 16, 1998

(86) PCT No.: PCT/IB98/00195

§ 371 Date: Oct. 9, 1998

§ 102(e) Date: Oct. 9, 1998

(87) PCT Pub. No.: WO98/37571

PCT Pub. Date: Aug. 27, 1998

(30) Foreign Application Priority Data

Feb. 24, 1997 (EP) ..... 97200507

(51) Int. Cl.[7] ..... H01J 17/04; H01J 61/04

(52) U.S. Cl. ..... 313/631; 313/633

(58) Field of Search ..... 313/623, 624, 313/631, 633, 567, 574, 578, 579

(56) References Cited

U.S. PATENT DOCUMENTS

| | | | | |
|---|---|---|---|---|
| 5,004,951 | * | 4/1991 | Honda et al. | 313/631 |
| 5,510,675 | * | 4/1996 | Bunk et al. | 313/631 |
| 5,614,787 | * | 3/1997 | Kawai et al. | 313/623 |
| 5,793,161 | * | 8/1998 | Peeters et al. | 313/631 |
| 6,060,829 | * | 5/2000 | Kubon et al. | 313/631 |

* cited by examiner

*Primary Examiner*—Michael H. Day
*Assistant Examiner*—Mariceli Santiago
(74) *Attorney, Agent, or Firm*—F. Brice Faller

(57) ABSTRACT

A high-pressure metal halide discharge lamp has opposed tungsten electrodes carried by electrode rods. These rods have a first portion of tungsten adjacent the electrodes and a second portion made of at least 25% by weight of rhenium. Their common boundaries are at a location having an operating temperature in the range of 1900–2100° K. The gas filling contains metal oxyhalide and is devoid of rare earth metal compounds.

6 Claims, 2 Drawing Sheets

HIGH-PRESSURE METAL HALIDE LAMP HAVING THREE PART ELECTRODE RODS

BACKGROUND OF THE INVENTION

The invention relates to a high-pressure metal halide lamp comprising:

a sealed light-transmittent discharge vessel having opposite seals and enveloping a discharge space which has a gas filling comprising rare gas and metal halides;

tungsten electrodes oppositely disposed in the discharge space;

current lead-through conductors located in a respective seal of the discharge vessel and issuing from the discharge vessel;

electrode rods connected to a respective one of said lead-through conductors and carrying a respective one of said electrodes.

Such a lamp is known from U.S. Pat. No. 5,424,609.

The known lamp has a ceramic discharge vessel, current lead-through conductors of e.g. niobium or tantalum, and a gas filling of rare gas, mercury and a mixture of metal iodides including rare earth metal iodides, being the iodides of the lanthanide's, scandium and yttrium, as the metal halides.

In ceramic discharge lamps the current lead-through conductors generally extend into the discharge space, thereby being exposed to attack by the metal halides. In the known lamp the inner ends of the current lead-through conductors are embedded in ceramic sealing material of the seals and a respective conductor which is said to be halide-resistant at least as its surface issues from the seals and connects the lead-through conductors with tungsten electrode rods. The said conductors at least at their surface consist of tungsten, molybdenum, platinum, iridium, rhenium, rhodium, or an electrically conducting silicide, carbide or nitride.

It was found that the known lamp suffers from a decreasing luminous output due to a blackening of the discharge vessel which is caused by the deposition of tungsten originating from the electrodes and the electrode rods.

A single ended quartz glass metal halide lamp is known from EP-A 0.343.625 in which the gas filling consist of rare gas, mercury and a mixture of metal iodides and metal bromides. Both lead-through conductors are embedded next to one another in the one seal of the discharge vessel and the electrode rods extend next to one another into the discharge space. Due to the elevated temperature of the electrode rods during operation and their short mutual distance, in such a lamp the discharge arc may jump over from the electrodes to the electrode rods, thereby approaching the discharge vessel and causing it to become overheated. The jump over of the discharge arc, however, also causes the electrode rods to become even more heated, to evaporate locally and thereby to blacken the discharge vessel and to become broken themselves. Moreover, the short distance in the kind of lamp between the electrode rods and the portion of the discharge vessel which is heated to softening in making the seal during manufacturing the lamp, causes tungsten electrode rods to become oxidized, which results in a fast blackening of the discharge vessel during operation.

In the lamp of EP-A 0.343.625 oxidation of the electrode rods and a jump over of the discharge arc are obviated in that the electrode rods at least at their surface consist of rhenium or rhenium-tungsten alloy. These electrode rods project through a tungsten electrode coil at their ends inside the discharge space. Rhenium is less liable to become oxidized and has a lower heat conductivity, whereby a rhenium electrode rod would assume a lower temperature during operation. Preference is given to rhenium-tungsten alloys containing 3 to 33% by weight of rhenium, because rhenium is an expensive metal. It was found, however, that the lamp has the severe disadvantage to suffer from a rapid blackening due to evaporation of rhenium and deposition of rhenium on the discharge vessel.

A similar single ended quartz glass lamp and a double ended quartz glass lamp are known from U.S. Pat. No. 5,510,675. These lamps have a gas filling of rare gas, mercury and a mixture of metal iodides and bromides. Their electrode rods have at their end inside the discharge space a wrap winding of tungsten wire and a fused spherically shaped tungsten electrode head. The purpose thereof is to eliminate flicker which is caused by migration of the discharge arc. The electrode rods may consist of rhenium in stead of tungsten. It was found that the lamp having rhenium electrode rods suffers from a rapid blackening due to evaporation of rhenium and deposition of rhenium on the discharge vessel. In the event the electrode rods consist of tungsten, blackening of the discharge vessel may occur as a result of evaporation of tungsten from the electrode rods and the electrodes, and deposition on the discharge vessel. Moreover in this event, the electrode rods may locally become thinner and thinner, resulting in the breakage of the rods at a relatively early moment:

SUMMARY OF THE INVENTION

It is an object of the invention to provide a high-pressure metal halide lamp in which blackening of the discharge vessel and breakage of the electrode rods are obviated.

This object is achieved in that the gas filling contains metal oxyhalide and is substantially devoid of rare earth metal compounds, the electrode rods have a first portion of tungsten adjacent the electrode which merges into a second portion at a location having a temperature in the range of 1900–2300 K during operation, the second portion is made of at least 25% by weight of rhenium, rest tungsten and being secured to a respective current lead-through conductor.

The invention is based on an insight having several aspects.

The discharge vessel may be kept clear by a fast acting regenerative cycle, by which evaporated tungsten is transported to the electrodes as tungsten oxyhalide, e.g. oxybromide. Tungsten oxyhalide decomposes near the electrodes and tungsten is deposited on the electrodes. Free halogen, e.g. bromine or iodine, and oxygen in the gas atmosphere of the operated lamp are essential to achieve a fast transport. Rare earth metals have a high affinity to oxygen, which results in stable oxides and excludes the existence of free oxygen in the gas atmosphere. Therefore, rare earth metals must be substantially absent.

Rhenium has a vapor pressure which increases rather steeply at increasing temperature. Rhenium cannot be returned to the electrode rods by means of halogen, because rhenium does not react with halogen or with halogen and oxygen. Rhenium must be avoided at locations having a relatively high temperature during operation.

Halogen, particularly bromine, and oxygen together form effective means to transport tungsten from locations of relatively low temperature, such as from the wall of the discharge vessel, to the electrode. However, the electrode rods, too, have locations of a temperature at which tungsten reacts with oxygen and halogen to form volatile compounds. The presence of oxygen and halogen in the gas atmosphere of an operating lamp, causes the electrode rods to become locally thinner until breakage occurs.

When the second portion is made of a tungsten/rhenium mixture, an amount of at least 25% by weight of rhenium in the mixture is necessary. When the tungsten is removed from the mixture by reaction with the halogen, a remainder of the second portion substantially consists of rhenium. Only when at least 25% by weight of rhenium is initially present in the mixture, the remainder of the second portion is strong enough to avoid breakage of the electrode rod. Halogen dosed into a lamp as the only intentionally added tungsten transport means could keep clear the discharge vessel without undue transport of tungsten from the electrode rods, by cooperation with unintentionally, as a contaminant, added oxygen. In this event, however, other contaminants in the gas filling, on the electrodes and their rods, and on the discharge vessel, such as carbon, iron, phosphorus and hydrogen, may have a strong influence either on the transport of tungsten towards the discharge vessel or towards the electrode.

By making the electrode rods to have rhenium in the second portion thereof, reactions of that portion with bromine and oxygen are hampered. By making the first portion of the electrode rods from tungsten it is avoided that a strong evaporation occurs, as it would be the case in the event the first portion consists of rhenium. The temperature of the common boundary of the first and the second portions is chosen to be about the temperature at which both the rhenium vapor pressure at higher temperatures and the sum of the tungsten vapor pressure and the pressures of tungsten compounds at adjacent lower temperatures than the boundary temperature would be substantially higher.

A first tungsten rod may be welded, e.g. butt welded, to a second rhenium or rhenium alloy rod, e.g. by resistance welding or laser welding. In this event the second rod may be chosen to be slightly, e.g. 10 to 15%, thicker, if so desired, in order to compensate for the lower heat conductivity of rhenium: $S_{Re} \approx 0.3 * S_{W.}$ The common boundary of the first and the second portions is at a location having a temperature during operation of 1900–2300 K. This temperature may be chosen for a particular type of lamp in dependency of the gas filling and the quality of the manufacturing process, which could cause the lamp to contain more or less contaminants influencing the total vapor pressure of tungsten and tungsten compounds. For each type of lamp the optimum temperature of said common boundary can easily be determined in a small series of test lamps by monitoring the luminous efficacy of the lamps during their life. Generally, it is favorable to have the boundary at a temperature in the range of 2100–2300 K.

In a favorable embodiment a common boundary region is formed by the first and the second portion over which during lamp operation the temperature lies between 2300 and 1900 K and in which boundary region the second portion is enclosed by a mantle substantially made of tungsten. This is realized e.g. by an electrode rod having a core made of rhenium or a rhenium alloy and a mantle made of tungsten or e.g. by an overlapping of the wrapped tungsten wire from the first portion with the rhenium containing portion. An electrode with this type of boundary allows a less accurate production of the boundary of the first and the second portion, since, due to an overlap of the first and the second portion. Less accuracy is allowed since the position of the boundary is self-adjusting during operation of the lamp. Subsequently, such an electrode rod facilitates the processing of the lamp.

In a further favorable embodiment the electrode rod consists of three portions. A first portion of the electrode adjacent the electrode tip is made of tungsten, a second rhenium containing portion which during operation of the lamp extends over the temperature range of the electrode of 1400–2300 K, and a third portion in which the rhenium containing portion is replaced by another material e.g. tungsten, molybdenum or tantalum. The third portion may begin at a location where the electrode surface is hardly accessible by the gases of the filling of the lamp. The temperature at this location is lower than 1400 K during normal operation of the lamp. The third portion is secured to the current lead-through conductor. The electrode is cheaper and the material that extends into the pinch can be chosen independently.

The gas filling may, apart from bromides like sodium bromide, thallium bromide, indium bromide or other non rare earth metal bromides, contain metal iodides, such as sodium iodide and stannous iodide. Oxygen may have been introduced into the discharge vessel e.g. in admixture with rare gas, or as a compound e.g. as an oxyhalide or as tungsten oxide. Metal oxyhalides, particularly tungsten oxyhalides, such as $WOI_2$, $WO_2Br_2$ and $WOBr_2$, will be formed during operation of the lamp. Not operated, the lamp may have a deposit of tungsten oxide on the wall of the discharge vessel.

The electrodes may be the tips of the electrode rods, i.e. the tips of the first electrode rod portions, or separate bodies secured to the electrode rods, or fused end portions of the electrode rods. A wire wrapping, generally of tungsten wire, may be present near the electrodes, e.g. to adjust their temperature.

The discharge vessel may consist of ceramic, e.g. of mono- or polycrystalline alumina, or of high silica glass, e.g. of quartz glass. The discharge vessel may be surrounded by an outer envelope, if so desired. An outer envelope may be filled with inert gas or be evacuated. The lamp may be socketed, e.g. at one or at both of its ends.

The lamp of the invention may e.g. be used with fiber optics, as a projection lamp etc., and particularly in those applications in which an unobstructed light ray path from the discharge arc to outside the discharge vessel or in which long life times and a good luminous maintenance are required.

DETAILED DESCRIPTION OF THE PREFERRED EMBODIMENTS

Figure 1:
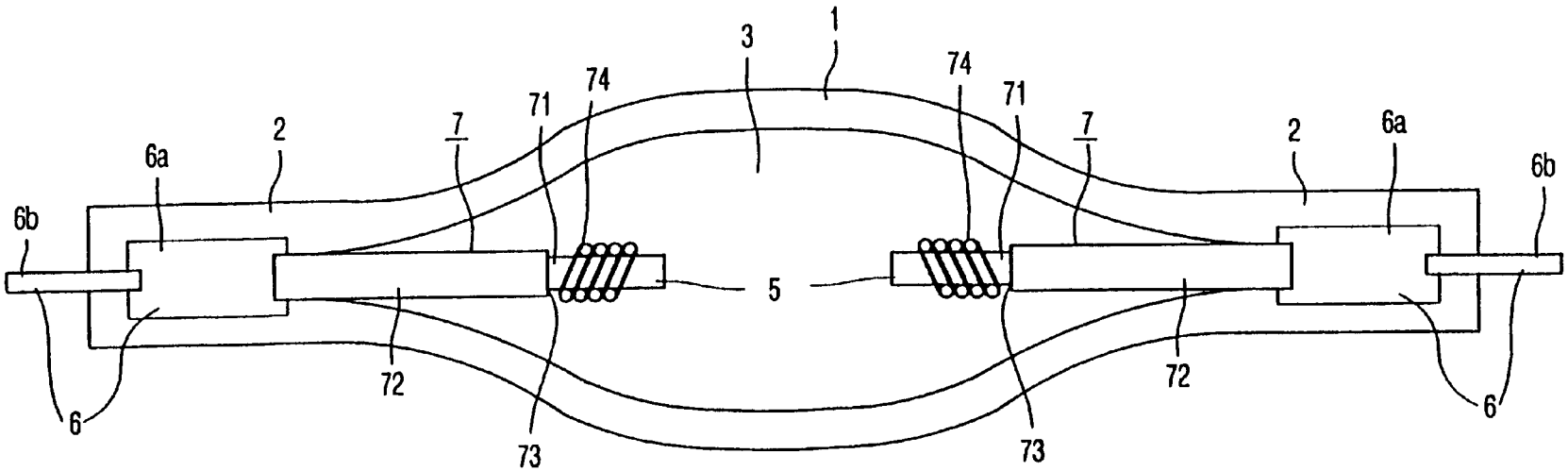
FIG. 1 is the lamp in side elevation.

The high-pressure metal halide lamp of FIG. 1 has a sealed light-transmittent discharge vessel 1, in the FIG. of quartz glass, but alternatively of mono- or polycrystalline ceramic, which has opposite seals 2 and which envelopes a discharge space 3. The lamp shown in FIG. 1 is an AC-lamp, but DC-lamps fall within the scope of this invention as well. The discharge space has a gas filling comprising rare gas and metal halides. Tungsten electrodes 5 are oppositely disposed in the discharge space 3. Current leadthrough conductors 6 are located in a respective seal 2 of the discharge vessel 1 and issue from the discharge vessel. In the FIG. the current lead-through conductors are each composed of a metal foil 6*a*, e.g. of molybdenum, which is fully located inside a respective seal, and of a metal rod 6*b*, e.g. of molybdenum, which extends to outside the discharge vessel 1. Electrode rods 7 are connected to a respective one of said leadthrough conductors 6, in the FIG. by welding them to the metal foils 6*a*, enter the discharge space 3 and carry a respective one of said electrodes 5.

The gas filling contains metal oxyhalides and is substantially devoid of rare earth metal compounds. The electrode rods 7 have a first portion 71 of tungsten adjacent the electrode 5 which merges into a second portion 72 at a location 73 having a temperature in the range of 1900–2300 K, particularly 2100–2300 K, in the FIG. 2100 K, during operation. In the Fig. the second portions 72 of the electrode rods 7 consists of rhenium and are thicker, have a diameter of 1 mm, than the first portions 71, which have a diameter of 0.8 mm. The electrodes 5 in the Figure are free end portions of the first electrode rod portions 71.

In FIG. 1 the electrode rods 7 have at the first portion 71 a wrapping 74 of tungsten wire adjacent the electrodes 5, to adjust the temperature of the electrodes.

The lamp of FIG. 1 consumes a power of 200 W. The lamp, having a volume of 0.7 $cm^3$ and an electrode distance of 3 mm, was filled with 0.87 mg NaI, 0.45 mg $SnI_2$, 0.76 mg NaBr, 0.21 mg TlBr, 0.17 mg $HgI_2$, 2666 Pa $O_2$, 44 mg Hg and 10 000 Pa Ar. When the lamp is switched on, the oxygen reacts to form oxyhalides.

After 1600 hrs of operation, during which the common boundaries of the first and the second electrode rod portions were at a temperature of about 2100 K, the discharge vessel was still fully clear the lamp had not reached the end of its life, yet.

This is in contrast to a test lamp in which one of the electrode rods was of the design shown in FIG. 1 and the other consisted of tungsten. The electrode distance was 5 mm. The lamp had a filling of 0.89 mg $SnI_2$, 0.14 mg $HgI_2$, 0.13 mg $WO_3$, 39 mg Hg and 10 000 Pa Ar. After 125 hrs of operation at a power of 200 W, the tungsten electrode rod broke down, thereby causing the end of the life of the lamp, whereas no signs of change of the other electrode rod were seen. The lamp vessel was still clean. When the lamp was first operated, the tungsten oxide reacted with halogen to form oxyhalide.

Figure 2A:
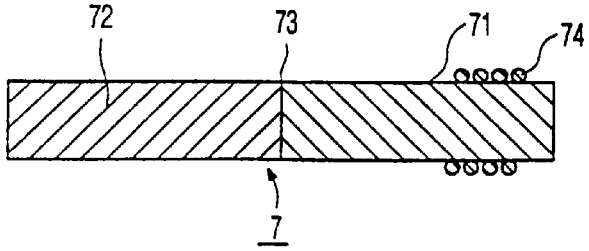
FIG. 2A–C are examples of various electrode rods in cross-sectional view.

In FIG. 2*a* the electrode rod 7 has a first portion 71 and a wire wrapping 74 of tungsten and a second portion 72 of rhenium/tungsten alloy up to the location 73.

Figure 2B:
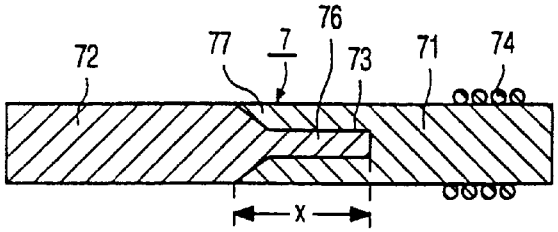

In FIG. 2*b* the electrode rod 7 has a first portion 71 and a wire wrapping 74 of tungsten, a second portion made of rhenium, which portions have a common boundary region at location 73. Location 73 extends over a distance X over the electrode rod 7. Over the distance X the temperature lies between 2300 and 1900 K during normal operation of the lamp. The location 73 is formed by the boundary region between a core 76 made of rhenium which is enclosed by a mantle 77 made of tungsten.

Figure 2C:
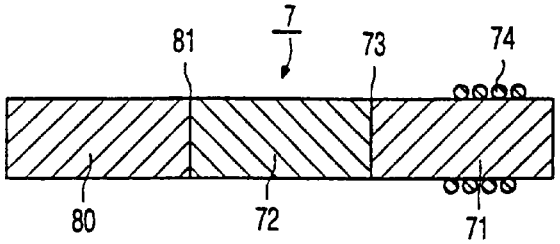

In FIG. 2*c* the electrode rod 7 has a first portion 71 and a wire wrapping 74 of tungsten, a second portion 72 made of a rhenium/tungsten alloy from locations 73 to 81 and a third portion 80 made of molybdenum.

Figure 3:
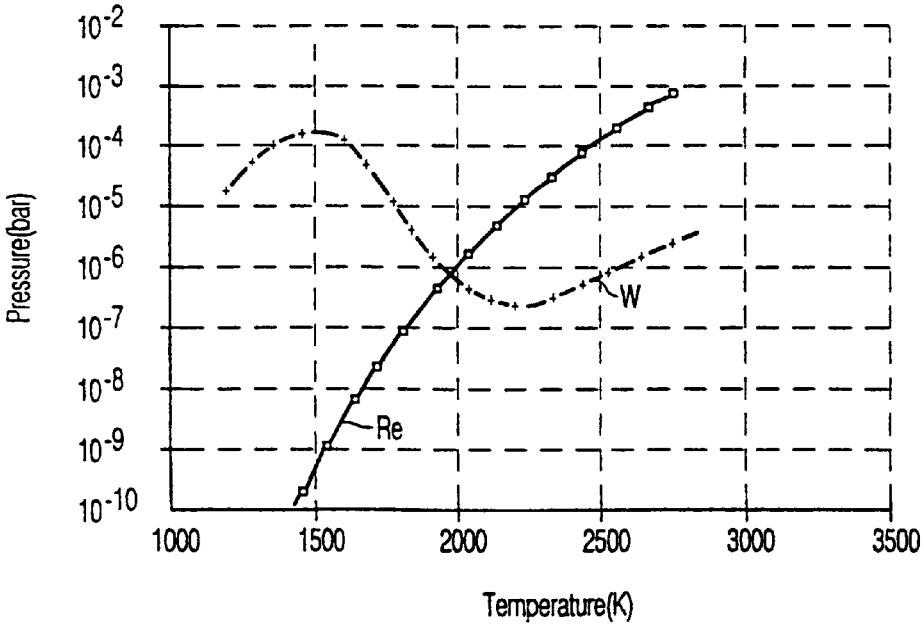
FIG. 3 is a graph showing vapor pressures.

In FIG. 3 the curve W designates the sum of the pressure of tungsten vapor and of the pressures of tungsten compounds in a lamp in dependency of the temperature, whereas the curve Re represents the rhenium vapor pressure at different temperatures.

It is seen, that the rhenium vapor pressure increases with an increasing temperature. Thus, rhenium evaporates faster the higher its temperature.

It is also seen, that the sum of the tungsten pressures is highest at about 1500 K and lowest at about 2250 K. This means that a tungsten surface of 1500 K will loose tungsten by evaporation and by chemical reactions giving volatile products, which will be transported and be deposited at a surface of about 2250 K, or higher due to faster decomposition reactions at higher temperatures, 2300–2500 K. These processes are not desired, because they would transport tungsten from a tungsten electrode rod towards the electrode; thereby causing the rod to become thinner and to break.

It is also seen, however, that the tungsten pressures at about 1150 K, that is at the wall of the discharge vessel, are relatively high. Tungsten will be transported, too, from locations of this temperature to locations of about 2200 K or higher. This transport is aimed at, because it keeps the wall clear.

In the Fig. the two curves intersect at about 2000 K. In a lamp in which the impurities influencing the volatility of tungsten compounds cause the W curve to be as shown, the temperature of the point of intersection of the curves is the proper temperature of the common boundary at the location 73 of the first 71 and the second electrode rod portions 72. If in the lamp the temperature of said common boundary would be higher than the one shown, the highest rhenium temperature in the lamp would be higher and there would be a higher rhenium evaporation. If in the same lamp the temperature of the common boundary would be lower, the highest rhenium temperature would be lower and as a consequence the rhenium vapor pressure would be lower, but the tungsten pressures at the boundary would be higher and consequently transport of tungsten from that place to places of higher temperature where the W curve has a minimum would occur. At other impurity levels in the lamp the W curve shifts to the right and the two curves intersect at a higher temperature. In a lamp without substantial impurities the curves will intersect at about 1900 K.

What is claimed is:

1. A high-pressure metal halide lamp comprising:

a sealed light-transmittent discharge vessel (1) having opposite seals (2) and enveloping a discharge space (3) which has a gas filling comprising rare gas and metal halides; said gas filling containing metal oxyhalides and being substantially devoid of rare earth metal compounds;

tungsten electrodes (5) oppositely disposed in the discharge space (3);

current lead-through conductors (6) located in respective said seals (2) of the discharge vessel (1) and issuing from the discharge vessel;

electrode rods (7) secured to respective said lead-through conductors (6) entering the discharge space (3) and carrying a respective said electrodes (5), wherein the electrode rods (7) each have a first portion (71) of tungsten adjacent the electrode (5) which merges into a second portion (72) at a location (73) having a temperature in the range of 1900–2300 K during operation, the second portion (72) is made of at least 25% by weight of rhenium, rest tungsten and being secured to a respective said current lead-through conductor (6).

2. A high-pressure metal halide lamp as claimed in claim 1, characterized in that the location (73) has a temperature in the range of 2100–2300 K during operation.

3. A high-pressure metal halide lamp as claimed in claim 1 wherein the second portions (72) of the electrode rods (7) consists of rhenium.

4. A high-pressure metal halide lamp as claimed in claim 3, characterized in that the second portions (72) of the electrode rods (7) are thicker than the first portions (71).

5. A high-pressure metal halide lamp as claimed in claim 1, characterized in that the location (73) is formed by a boundary region over which during operation the temperature lies between 1900 and 2300 K and at which boundary region the second portion (72) is enclosed by a mantle (77) substantially made of tungsten.

6. A high-pressure metal halide lamp as claimed in claim 1, characterized in that the electrode rods (7) comprise first (71), second (72) and third portions (80) in which the second portions merges into the third portions at second locations (81) having a temperature lower than about 1400 K during operation of the lamp and which third portions being secured to respective current lead-through conductors (6).

* * * * *